US007861874B2

(12) United States Patent
Cook et al.

(10) Patent No.: US 7,861,874 B2
(45) Date of Patent: Jan. 4, 2011

(54) CONTAINER AND REMOVABLE CLOSURE CAP WITH VENTING FEATURE

(75) Inventors: Stephen T. Cook, Dayton, OH (US); Mark F. Broerman, Kettering, OH (US); Dale R. Conley, Bellbrook, OH (US)

(73) Assignee: Dayton Systems Group, Inc., Miamisburg, OH (US)

( * ) Notice: Subject to any disclaimer, the term of this patent is extended or adjusted under 35 U.S.C. 154(b) by 940 days.

(21) Appl. No.: 10/519,613

(22) PCT Filed: Jun. 26, 2003

(86) PCT No.: PCT/US03/20283

§ 371 (c)(1),
(2), (4) Date: Aug. 22, 2005

(87) PCT Pub. No.: WO2004/002844

PCT Pub. Date: Jan. 8, 2004

(65) Prior Publication Data

US 2006/0011633 A1 Jan. 19, 2006

Related U.S. Application Data

(60) Provisional application No. 60/391,684, filed on Jun. 26, 2002.

(51) Int. Cl.

| | |
|---|---|
| ***B65D 41/06*** | (2006.01) |
| ***B65D 51/16*** | (2006.01) |
| ***B65D 53/00*** | (2006.01) |
| ***B21D 51/44*** | (2006.01) |
| ***B21D 51/50*** | (2006.01) |

(52) U.S. Cl. ..... 215/331; 215/307; 215/341; 220/298; 220/366.1; 220/304; 413/22; 413/24; 413/8

(58) Field of Classification Search ..... 215/341, 215/331, 307, 330; 220/304, 298, 296, 366.1; 413/22, 24, 8; 72/347–349
See application file for complete search history.

(56) References Cited

U.S. PATENT DOCUMENTS 5,135,124 A * 8/1992 Wobser ..... 215/222

(Continued)

FOREIGN PATENT DOCUMENTS

JP 2002019812 A * 1/2002

(Continued)

*Primary Examiner*—Robin Hylton
(74) *Attorney, Agent, or Firm*—Fay Sharpe LLP

(57) ABSTRACT

A resealable can end is provided including a neck (10) and a cooperating cap member (12) which can be sealed onto and removed from the neck, and is capable of containing product under pressure or vacuum if desired. This end may be added, by convention seaming methods, such as roll seaming or by appropriate adhesive, to a container body, or may be formed integrally with container bodies. The venting feature of the end will achieve a controlled release of differential internal-to-ambient pressure upon initial opening of the cap, and may also provide resealed containment of partial contents retained in the container, although the contents will no longer be under pressure or vacuum, as the case may be. The end may be applied to, or incorporated in, containers made of various material, such as aluminum, coated steel, or selected plastics.

12 Claims, 3 Drawing Sheets

U.S. PATENT DOCUMENTS 6,015,062 A * 1/2000 Bachmann et al. ..... 220/295
6,082,944 A * 7/2000 Bachmann et al. ..... 413/22
6,227,391 B1 * 5/2001 King ..... 215/307
6,234,338 B1 * 5/2001 Searle ..... 220/366.1
7,069,763 B2 * 7/2006 Cook et al. ..... 72/334

FOREIGN PATENT DOCUMENTS

JP 2002-114244 4/2002

* cited by examiner

1st Thread Profile with Cap at Closed Position

4th Thread Profile Becoming Disengage with Cap Lug

CONTAINER AND REMOVABLE CLOSURE CAP WITH VENTING FEATURE

PRIOR APPLICATIONS

This application claims the benefit of International Application No. PCT/US03/020283 International Filing Date 26 Jun. 2003 and U.S. Provisional Application Ser. No. 60/391,684, filed 26 Jun. 2002.

FIELD OF THE INVENTION

This invention relates to containers for various materials, for example flowable (i.e. non-solid) materials such as liquids, beverages or the like, and in which packaged materials may be maintained under pressure or in a vacuum. Thus the package interior may be at a differential pressure with respect to the package surroundings, until the container is opened. The principal feature of the invention is a reclosable cap (top) with lugs and cooperating neck lugs on the neck of the container, which feature can be applied to various containers such as cans or bottles, made from different materials such as metals, glass, or plastics.

BACKGROUND OF THE INVENTION

This invention is an improvement on the inventions disclosed in U.S. Pat. No. 6,082,944 issued 4 Jul. 2000 and its parent U.S. Pat. No. 6,015,062 issued 18 Jan. 2000.

Current commercially available forms of easy open container end, using a tear-open pour panel operated by an integral or "attached" tab, while universally acceptable in more affluent societies, particularly in the beer/beverage market, is somewhat of a luxury convenience item. These can be recycled insofar as they are constructed primarily of aluminum, but despite many efforts a fundamental but successful reclosable device or mechanism, particularly one built into the original container, has only recently been accepted in the marketplace, for a number of reasons. Prior art containers have thus been relegated to use as one time, throw-away packaging, and they are not per se capable of keeping contents secure while permitting intermittent partial dispensing of the contents after initial opening. Falling into this same category are containers with pour openings formed prior to filling, with a removable foil tab secured over the pour opening.

Thus, there is a marketplace need for containers which have a resealable feature and a controlled release (venting) feature for internal pressure or vacuum, which can be constructed of metal (aluminum, coated steel, etc.), of glass, or of a suitable plastic.

A reclosable feature, for quick on-off convenience, has become available in plastic (non-metallic) containers (ordinarily blow-molded) for carbonated beverages, in two liter, one and one-half liter, and one liter (0.59 ml) sizes. Most of those containers have a frangible, sealed and replaceable screw-on cap molded of aluminum or a suitable plastic, which is relatively small and can impede pouring.

Thus, there is still a need for a reclosable container which, as part of the original container construction or assemblage, can again be closed and sealed to retain part of the contents under sealed conditions. Another need is for a mouth construction more acceptable than easy-open containers for direct drinking of fluid contents in the container.

U.S. Pat. No. 6,082,944, assigned to the assignee of this application, discloses a reclosable and resealable type of system, primarily for cans, in which a multi-lugged cap is provided along with a dome for attachment to a can body. The dome has a neck formed with complementary outwardly protruding neck lugs, circumferentially spaced apart, that cooperate with the cap lugs to draw the cap into a sealed relationship around the discharge (egress) opening of the dome. That system, however, lacks a provision for controlled venting of pressure differential upon initial opening when the contents of the container are pressurized or under vacuum. An apparatus and method for making the domes is disclosed in the assignee's PCT application US02/06046 filed 27 Feb. 2002.

Therefore a market exists for containers, and particularly for packaging contents under pressure (e.g. beer/beverage containers) or under a vacuum (e.g. for fluids or semisolid foods), which have a reclosable feature, a venting feature if desired, and which can be constructed either of metal (aluminum, coated steel, etc.), or of glass or suitable plastic or combinations thereof.

SUMMARY OF THE INVENTION

The present invention provides a closure construction for reclosable containers, e.g. a metal can body or a glass or plastic bottle, wherein the container top end has a neck with an dispensing opening (e.g. a mouth) fitted with a reclosable type of lugged cap. In a metallic embodiment of the invention the container top, fitted with special lugs and an attached sealing cap, can be attached to the open end of a two or three piece can body, for example by a known double rolled seam connection, or by use of a suitable adhesive. Filling can be accomplished before attaching the end, or after attachment of the end to a container body, through the dispensing opening.

The invention can also be incorporated into a unitary can body, in which instance the can body would be filled and then closed by attaching the cap. In a glass or plastic embodiment of the invention, the neck is formed (e.g. molded) on a container of glass or plastic material or a suitable sleeve fitted to the neck, and the special lugs are thus included in the neck formation. The lugged cap may be attached after filling the container.

In all cases, the neck includes the dispensing opening at its upper end with a seal surface formed around such opening. Special lugs (hereinafter called neck lugs) on the container neck are located a predetermined distance from the seal surface. These neck lugs, normally at least three, cooperate with cap lugs to provide for a slightly opened position of the cap by which the seal is sufficiently released to vent the container, through the dispensing opening, but the cap is not removable from the container without further manual manipulation of the cap to a fully released location.

The lower surfaces or undersides of the neck lugs are designed to interact with the cap lugs so as to achieve the sealing, venting, releasing, and resealing of the cap onto the neck. The underside of the cap is (preferably) fitted with a seal member, which maybe annular or cover the majority of the cap underside. This seal member seals against the top of the neck, around the dispensing opening. The upper or top sides of the neck lugs may be of different configuration, so long as they do not interfere with or inhibit the desired interaction of the cap lugs with the neck lugs on the neck.

In a preferred construction two or more first type of neck lugs includes a central underside portion which is generally transverse to the neck (essentially parallel to the seal surface), a downward extending (away from the seal surface) stop portion at one end of the central portion, and an upward extending underside entrance ramp at the other end of the central portion.

A second type of neck lug, or pair of necks, includes a central underside portion also transverse to the neck, the same type of downward extending stop portion at one end of the central portion, and an upward extending underside entrance ramp having a steeper slope and extending into a venting portion generally parallel to but spaced above the central portion. The venting portion ends in a retainer hook extending downward to the level of the central portion. The total length of the neck lugs spaced apart about the container neck is less than the circumference of the neck by a predetermined amount.

The spacing of the neck stop portions from each other around the container neck will be approximately equal to the number of necks; for example, with three neck lugs this spacing will be 120° and with four necks this spacing will be 90°. The spaces or gaps between the neck lugs are of sufficient width circumferentially of the neck to allow the cap lugs to pass through, as further explained below.

The lower edges of the neck lug central portions extend around the neck at a predetermined level or spacing below the top of the neck. This spacing is determined to maintain contact with the cap lugs and keep the cap interior in tension against the seal surface, to maintain a complete seal around the dispensing opening or mouth of the neck. The entrance ramp and exit ramp neck portions extend upward from the flat portions to a level slightly above and spaced from the stop portions of the next adjacent flat portions, so as to define a passage between these neck lugs through which the cap lugs can pass during attachment and detachment of the cap with respect to the neck.

Assuming a container is filled, and its cap is in place on the container neck with cap lugs engaged under all of the neck lugs, when the cap is subjected to an initial opening motion, a certain one (or ones) of the cap lugs will progress onto the venting portion(s) of the neck lugs which have such portions, and the internal pressure in the container will raise part of the cap in a region corresponding to that venting portion. This releases or substantially reduces the sealing pressure and a vent region or path is formed between a part of the cap periphery and the seal, and extending down between the inside of the cap and the container neck. The stop portions depending from the ends of the venting neck portion(s) provide a rotational limit to further cap rotation, while venting continues. Normally, this venting occurs rapidly, in a fraction of a second.

In the case of a container product packed under vacuum, differential pressure acting on the area of the cap within the seal will hold the cap in place, but the cap lugs will still be pressing against the neck lugs. As the cap is rotated, the seal will remain against and slide around the mouth of the container. Continued rotation will bring at least one of the cap lugs into alignment with a space between the neck lugs and into engagement with a lifting lug portion on the next neck lug. As the cap rim rises during rotation, the cap lug will transition over the upper surface of the lifting lug portion of the next neck lug. Then further cap rotation will force the portion of the seal adjacent to such cap lug to separate form the rim of the dispensing opening, thereby overcoming the force of the negative pressure within the container, and venting the container interior to ambient pressure.

In another embodiment of this invention the angular extent (i.e. circumferential arcuate length) of these special neck lugs differs from one lug to the others. When the cap seal is seated on the dispensing opening, and the cap is rotated in a direction to remove the cap, at least two of the cap lugs will move into the passage space before the other cap lugs do so. At that time in the opening operation, the force acting to seal the cap is lessened and internal pressure in the container begins to equalize with the container exterior as the seal is progressively released. During this action, one or more of the other cap lugs remain in contact with the other flat neck lug portions. Each one of the successive neck necks is progressively of lesser circumferential length, such that the pressure equalizing is accelerated as all of the cap lugs move into the passage spaces and the cap can be removed from the neck.

Thus the invention provides unique and versatile containers for fluids, particularly for beverages, wherein various bottles or can bodies are provided with a special end including a neck with a dispensing opening, a special neck-like lug formation on the neck below the dispensing opening, a reclosable cap having a lug formation which will interlock with the neck-like lug formation on the neck. A seal structure, preferably on the cap interior, surrounds the dispensing opening in positive contact with the cap seal and maintains product under desired pressure or vacuum in the container.

In the metallic can body version of the invention, the neck or spout can be part of an end which can be attached to a can body by a seam between the bottom of the end below the neck and the rim of the can body, or such neck can be formed integrally with the can body. In the glass or plastic bottle version, the neck can be an integral part of a bottle or jar, including a seal surface around the dispensing opening at the top of the neck. The basic design and function of the lugged cap closure system is the same in both versions. Each version also includes a relatively large dispensing opening which is comfortable to someone drinking directly from the container. This novel cap and neck construction will also provide a neck with a cap that is not only reclosable but resealable.

Other objects and advantages of the invention will be apparent from the following description, the accompanying drawings and the appended claims.

DESCRIPTION OF THE PREFERRED EMBODIMENTS

Pressure Venting

The principal feature of the invention is a reclosable cap and cooperating neck lugs on the neck of the container, which feature can be applied to various containers, for example cans or bottles, made from different materials.

Figures 1, 2, 3, 4, 5:
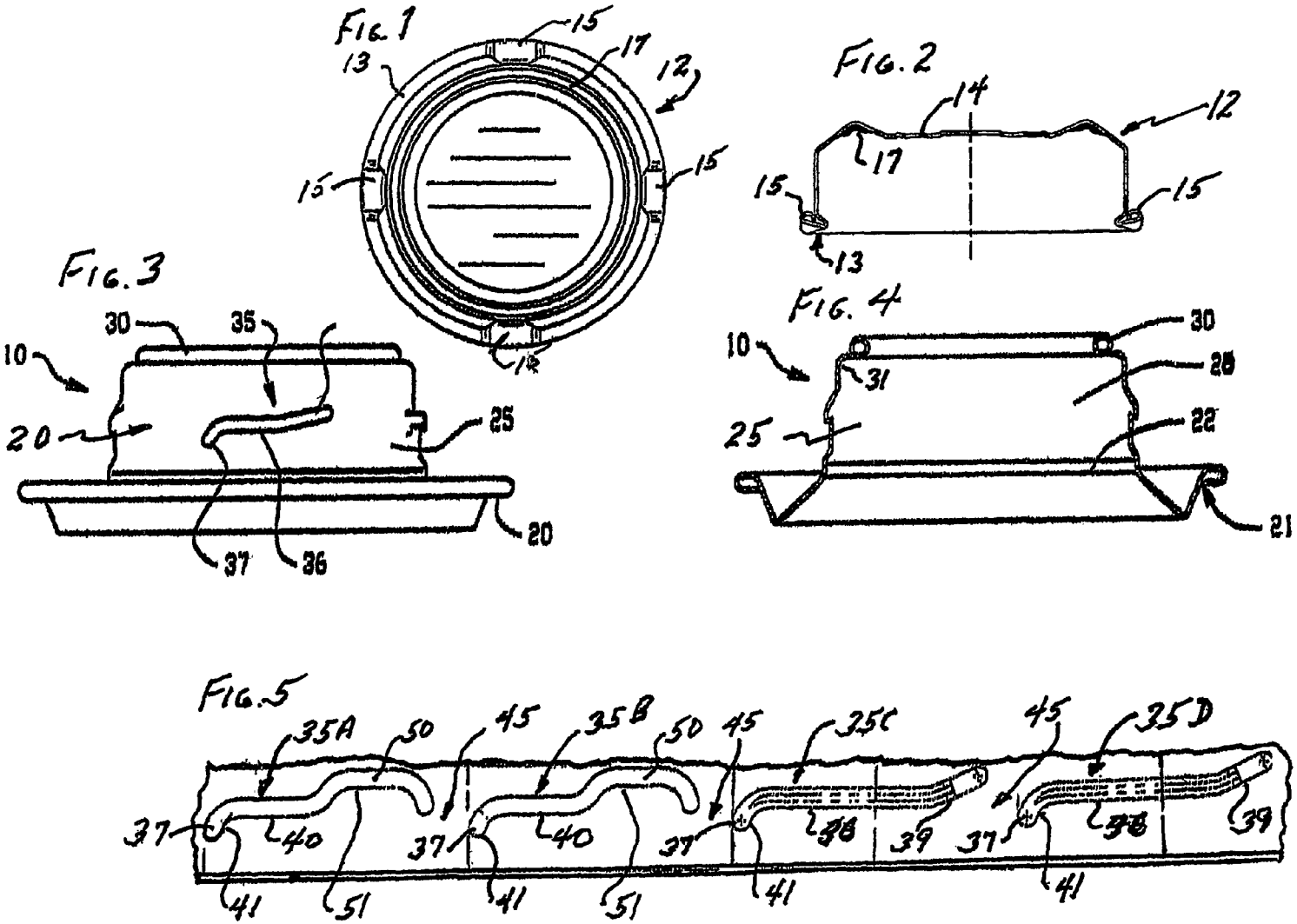
FIG. 1 is a bottom view of a cap, showing four cap lugs and the interior cap surface including a generally annular seal.
FIG. 2 is a side cross-section view taken across FIG. 1 with the rim and lugs of the cap at the bottom, showing a typical four lug cap according to one preferred embodiment of the invention.
FIG. 3 is a side view of a container end and its neck including the mouth and dispensing opening at the upper end of the neck and showing the necks on the neck.
FIG. 4 is a cross-section view of the end, generally aligned with FIG. 2 to show the necks formed outwardly from the neck and spaced below the lugs on the cap.
FIG. 5 is a layout view of the area about the neck, showing the neck lugs in a plane (instead of a cylinder) and illustrating the shape and formation of the different neck lugs.
Figure 6:
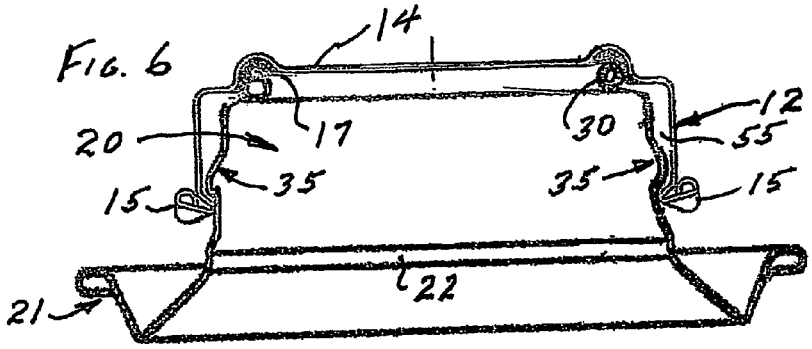
FIG. 6 is a cross-section view of the cap (FIG. 1) affixed to the neck (FIG. 9) of a preferred embodiment.

Dimensions, where shown, are for the purpose of explanation and are not limitations on the scope of the invention. The container end of the present invention, as executed in metal (preferably aluminum), is comprised of two major parts, a neck structure 10 (FIGS. 3 and 4), and a cap member 12 (FIGS. 1 and 2). The cap is in the general form of an inverted cup, including an outwardly curled lower rim 13 depending from the top panel 14 of cap member 12. Four cap lugs 15 are formed 90° apart on rim 13, and the interior surface beneath the top of the cap includes a seal member 17. As will be noted in FIG. 1 the cap lugs 15 are tapered to a smaller inner end as they extend generally radially inward from rim 13.

Referring to FIGS. 3 and 4, a neck (or spout) 10 is formed upward and integrally from an outward extending dome or equivalent can top structure 20 with a lower rim 21 capable of being attached (for example roll seamed) to the upper end or rim of a can body. The can top rim 21 optionally may include a sealing compound on the underside of rim 21. It should be noted that rim 21 may be constructed as an essentially flat surface, having only a quite small taper upwardly from its out edge, and rim 21 may also be formed to fit with the top of a can body and seamed thereto with a suitable adhesive, instead of a rolled seam.

The neck 10 in turn includes an integral generally cylindrical upper neck section 25 formed thereon, terminating in an upper edge in a outward curled seal rim 30 providing the seal surface formed upon a ledge 31. An elastomeric preferably circular seal 17, which may take different forms, is fitted within cap 12 and is intended to be held against the entire periphery of seal rim 30.

Extending outward from upper neck section 25 are a first set of elongated neck necks 35A, 35B, 35C, and 35D. These special lugs on the container neck are constructed with a central flat portion 36 (the cam portion), a downward extending stop portion 37 at a first end of a generally horizontal portion 36 and, on lugs 35C and 35D, an upward extending entrance/exit ramp portion 39 at the other or second end of horizontal portion 36. The cumulative length or wrap of the neck lugs about the container neck is less than the circumference of the neck, leaving spaces therebetween through which the cap lugs 15 can pass as the cap is placed on, or removed from, the neck. The angular spacing of the stop portions 37 from each other around the container neck will be approximately equal to the number of necks; for example, with four necks this spacing will be 90°. It is possible to construct neck lugs of reverse configuration, such that they would function as a left-hand (or reverse) neck if such a feature were desired for some reason.

Figure 7:
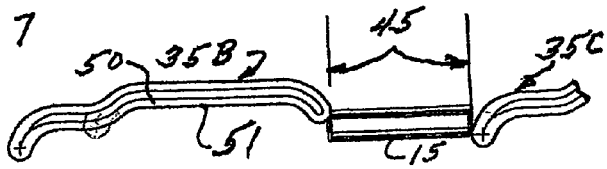
FIG. 7 is view similar to FIG. 5, illustrating the incorporation of one or more neck lugs having a lifting portion for release of container vacuum.

The lower edges 40 of all the neck lug flat portions 36 extend around the neck 20 at a level below the seal surface 30 which is determined to maintain contact with the cap lugs and keep the cap interior and its seal 17 in tension against the seal surface 30. The entrance/exit ramp portions 39 on necks 35C and 35D provide an extended horizontal portion 36 and then extend upward from the horizontal portions 36 to a level above and spaced from the stop portions 37 of the next adjacent horizontal portions 36, so as to define passages 45 between these necks through which the cap lugs 15 can pass during attachment and removal of the cap to the neck (see FIG. 7). The stop portions 37 depend from the first ends of these neck lugs and their lower surfaces 41 provide a rotational limit to cap rotation during attachment of the cap to the neck.

Comparing the four neck lugs shown in FIG. 5, neck lugs 35A and 35B have upwardly extending venting portions 50 with lower surfaces 51 which are at a higher level than lower surfaces 40. These venting portions 50 are turned downward at the second ends of neck lugs 35A and 35B, and end at a level generally corresponding to the lower surfaces 40 of the neck lugs.

For purposes of explanation, assume a cap is attached to the dome, with cap lugs 15 moved through spaces 45 and tightened by rotating it clockwise (as viewed from the top), such that the cap lugs 15 are pressing against the lower edge 40 (or cam surface) of all the neck lugs 35A, 35B, 35C and 35D; this would be the normally expected rotation for applying and tightening a cap. Assume also that the container contents are (or will be) under pressure and there is a force component due to such pressure on the interior of cap 12. To release or vent such pressure, cap 12 can be rotated counterclockwise until two consecutive ones of cap lugs 15 move into the venting portions 50 of neck lugs 35A and 35B. The other two cap lugs remain in contact with the extended lower surfaces 40 on neck lugs 35C and 35D.

This causes the cap to tilt in the region above those venting portions and the force (pressure or vacuum) holding the seal 17 against rim surface 30 is relieved. A slight space, e.g. a venting passage, occurs through the 'lifted' segment of seal 17, into space 55 between cap 12 and neck section 25. Further rotation of cap 12 is resisted by engagement of cap lugs within the venting portions 50. The vented gases follow a circuitous path around the dome neck section 25, between the space between that neck and the cap side, past the spaces between the neck lugs 35, and under the lower outer rim of the cap. However, in the instance of internal pressurized product, the cap is retained from being forced off (or possibly ejected from) the neck section 25. Once the pressure within the container essentially equates with ambient pressure, cap 12 can be further rotated to move the two cap lugs beyond the venting portions 50 and into the passages 45. The other two caps lugs will move up the neck ramps 39, and as the cap rotation continues the first two cap lugs, within the venting portions 50, move under the downturned ends of neck lugs 35A, 35B. All the cap lugs 15 can then pass through openings 45 and the cap may be fully removed.

Vacuum Venting

Figure 8:
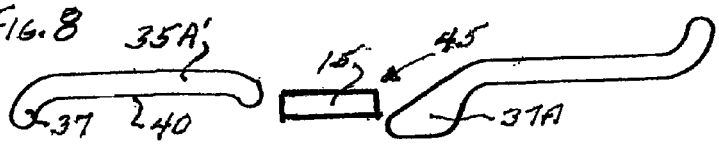
FIG. 8 is an enlarged detail view of one cap lug aligned with the space between the ends of two successive neck necks.
Figure 9:
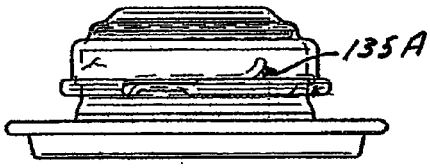
FIG. 9 is a view of another embodiment of the invention, including a cap generally as shown in FIGS. 1 and 2 and a neck with four necks of a different configuration shown in fully closed position on a neck.

Referring to FIG. 8, in the case of container contents under a vacuum (below ambient pressure) venting occurs in a modified procedure. The neck lugs 35 may be of the general construction as lugs 35A and 35B. The same reference numerals are used to identify parts of the same construction. As a practical matter, the venting portions 50 can be omitted in this vacuum venting feature, and the flat portions 40 simply extended to the full length of the neck lugs, or the venting portions can be included to minimize extra tooling costs. Since the differential pressure due to vacuum internal of the filled container holds the cap onto the seal rim, rotation of the cap in the removing direction will slide its cap lugs along the neck lug flat portions 40 but the caps lugs will not rise into the venting portions 50; thus the venting positions (if present) are not functional in this embodiment.

Thus, to vent the container at least one of the neck lugs (35A is shown) is provided with a downwardly extended deflecting portion 37A on its stop portion 37. When rotation of the cap (in a opening action) brings a cap lug 15 into engagement with the deflecting portion 37A, that cap lug moves up the deflecting portion (FIG. 8) and raises a portion of the cap and seal off the seal rim and this results in venting of the container by allowing ambient air flow between the cap and the container neck until the internal container pressure rises to ambient pressure. Again, this will happen in a fraction of a second. Continued rotation of the cap will assure that all the cap lugs 15 pass through the openings 45 and the cap can be removed. Of coarse, although the cap can be replaced, once the vacuum is released it will not be restored simply by replacing the cap on the container, but the seal can be restored to protect remaining product in the container.

Further Embodiment with Pressure or Vacuum Relief

An important feature of a further embodiment of this invention involves varying the extent (i.e. length about the neck) of a second form of special neck necks. At least one adjacent pair of these necks is of lesser length than the others, such that the passage space between its entrance/exit ramp and the adjacent neck is enlarged. Thus, when the cap is seated on the neck opening seal, and is rotated in a direction to remove the cap, two of the cap lugs will move into these passage spaces before the other cap lugs do so.

Figure 10:
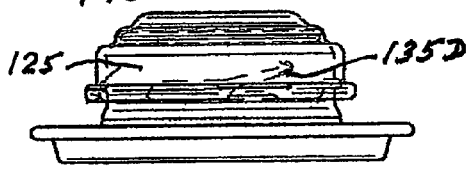
FIG. 10 is a view similar to FIG. 9, with a cap in fully open position ready for removal.
Figure 11:
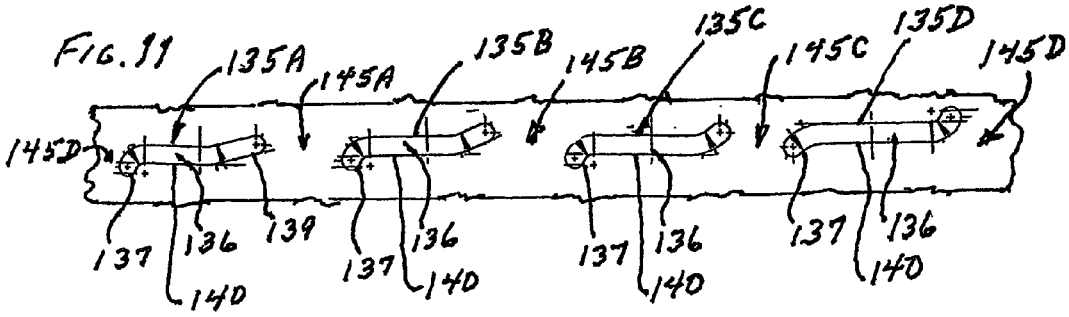
FIG. 11 is a segmental layout view, similar to FIG. 5, showing four adjacent neck lugs employed in the embodiment of FIG. 9.

In the illustrated embodiment, extending outward from upper neck section 125 is a set of elongated neck necks 135A, 135B, 135C, and 135D (FIG. 10). These special necks on the container neck are constructed with a central flat portion 136, a downward extending stop portion 137 at one end of flat portion 136, and an upward extending entrance/exit ramp portion 139 at the other end of the flat portion. The cumulative length of the necks about the container neck is slightly less than the circumference of the neck. The four necks are of progressively shorter length, for example neck 135A is the shortest, neck 135D is the longest, and necks 135B and 135C are of different intermediate lengths. Therefore, one edge of each of the passage spaces 145 will be located 90° apart. Space 145A is the largest, and space 145D is the smallest. This relationship is a part of a four neck embodiment, but it should be understood that the invention can be allied to ends using three or more necks and cap lugs.

At the time of "opening", two of the cap lugs enter the first passage 145A and passage 145B. The other two caps lugs engage the undersides of necks 135C and 135D. In the case of pressurized contents, the internal force against the cap interior causes the cap to begin to tilt and release pressure against seal 132. This condition increases and progresses until all of the cap lugs are free of contact with neck necks, and internal gas in the container escapes through the seal interface to vent until the internal pressure reaches ambient pressure (outside the container). Similarly, if the product in the container is packed under vacuum, turning and tilting of the cap during opening will allow ambient pressure to cause air flow into the container under a controlled action.

The spacing of the neck stop portions from each other around the container neck will be approximately equal to the number of necks; for example, with four necks this spacing will be 90° on centers of the neck necks.

Similar to the first described embodiment, the lower edges 140 of the neck lug flat (horizontal) portions 136 extend around the neck 111 at a level below the seal surface which is determined to maintain contact with the cap lugs and keep the cap interior seal in tension against the seal surface 130. The entrant/exit ramp neck portions 139 extend upward from the flat portions 136 to a level slightly above and spaced from the stop portions 137 of the next adjacent flat portions, so as to define passages 145 between these necks through which the cap lugs 115 can pass during attachment and detachment of the cap to the neck. Finally, the stop portions 137 depend from the opposite ends of these neck necks and provide a rotational limit to cap motion during attachment of the cap to the neck.

An important feature of this embodiment of the invention is the angular extent (i.e. arcuate length about the neck) of these special neck lugs. At least one of these neck lugs is of lesser length than the others, such that when the cap is seated on the neck opening seal, and is rotated in a direction to remove the cap, at least one of the cap lugs will move into a passage space before the other cap lugs do so. When used with pressurized products, at the time this operation is initiated, the internal force against the cap interior causes the cap to begin to tilt and release pressure against seal 32 and the internal pressure container is released or vented in a controlled manner until the internal pressure reaches ambient pressure (outside the container). This condition progresses until all of the cap lugs are free of contact with neck lugs.

Figure 14:
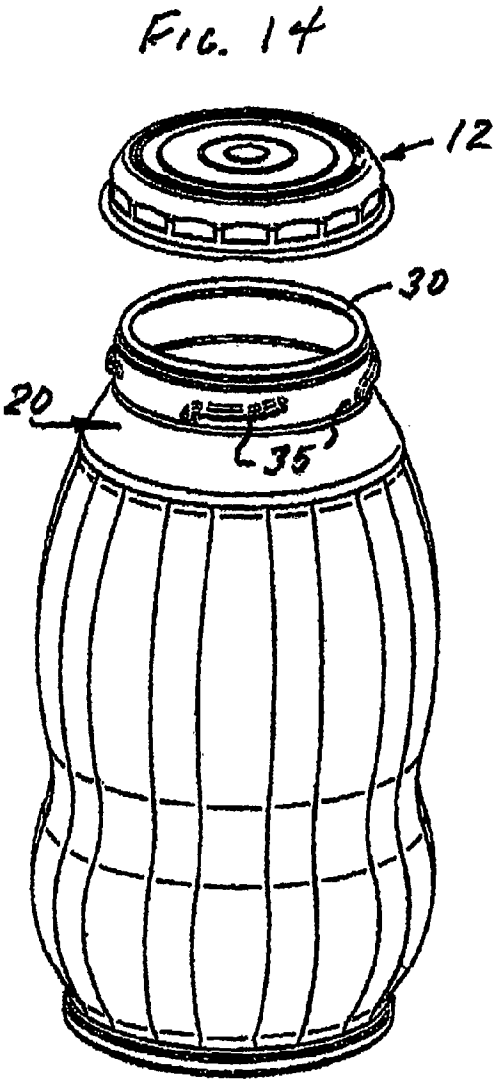
FIG. 14 illustrates an end according to the invention fitted to the top of a shaped container body, which may be of two-piece (illustrated), three-piece, or unitary design.
Figure 13:
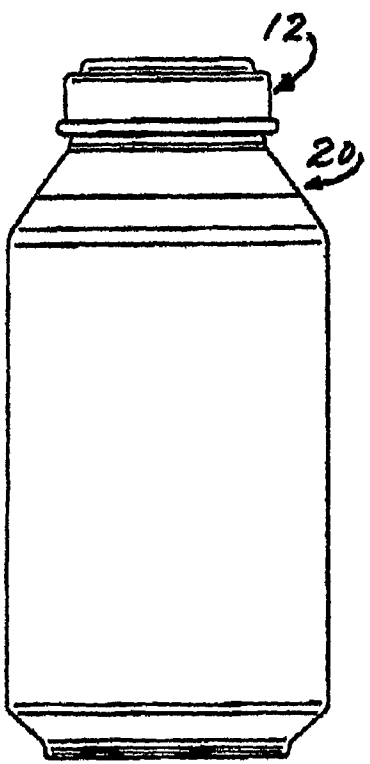
FIG. 13 illustrates an end according to the invention formed on a unitary can body, with a cap attached.
Figure 12:
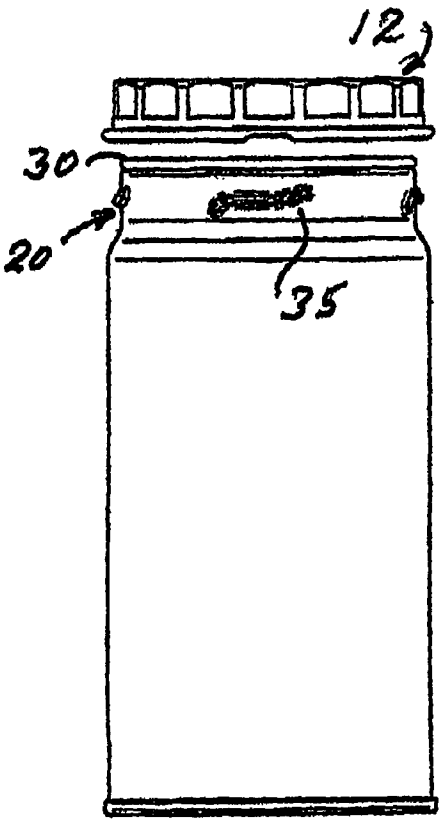
FIG. 12 illustrates an end according to the invention fitted to the top of a two-piece container body, with a cap spaced above the neck.

It is intended that the end dome with its integral neck structure, including the special necks described herein, may be manufactured in high speed presses (reciprocating or rotary), although other forms of fabrication are within the scope of the invention. The special necks may be formed on a dome structure to be later attached to a can body (FIGS. 12 and 14), or they may be formed on a neck which is formed as an integral part of a can body (FIG. 13).

While the articles and methods of making them herein described constitute preferred embodiments of this invention, it is to be understood that the invention is not limited to these precise articles and methods, and that changes may be made in either without departing from the scope of the invention, which is defined in the appended claims.

What is claimed is:

1. A container end for a container, said end comprising a neck portion forming a spout on a container body;

said neck portion having a generally cylindrical part including an upper end with an opening having a surrounding seal surface defining a dispensing opening;

circumferentially spaced neck lugs formed outward to a first diameter about said cylindrical part for cooperation with a closure cap, the neck lugs including a first set having a first conformation and a second set having a second conformation different than the first conformation;

a removable closure cap adapted to cover said dispensing opening, said cap including a top panel and a cap rim shaped to extend downward from said top panel and adapted to surround said upper end of said neck, said cap rim terminating in a generally circular lower edge;

a seal member within said cap on the underside of said top panel;

a set of lugs formed inward within said rim of said cap to a second diameter less than said first diameter of said first and second sets of neck lugs to latch under said neck lugs and to retain said seal member in sealed relationship with said seal surface;

said first set of neck lugs each having an upward extending ramp portion and a generally flat cam surface facing downward of said neck portion at the same spacing from said seal surface for compressing said seal member against said dispensing opening; and at least one second neck lug including a lower surface facing downward of said neck portion and a venting portion at a higher level than the lower surface, the venting portion further having a downturned end that extends to at least a level corresponding to the lower surface allowing at least one of said cap lugs to release from a neck lug and to free a segment of said seal member from the seal surface at least adjacent to the second neck lug, thereby initiating a venting path through said cap rim through which path relative pressure between the interior and exterior of the container is equated while said seal member and seal surface continue to be partially engaged.

2. A container end as defined in claim 1, wherein said seal member is an elastomeric ring-like member contained within said rim of said cap adjacent the junction of said top panel and said rim.

3. A container end as defined in claim 1, further comprising:

an outward curl formed on said lower edge of said rim of said cap; and said cap lugs extending inward from said outward curl.

4. A container end as defined in claim 1, further including said neck portion having a lower end and a rim at the bottom of said lower end for joining to the body of the container.

5. A container as defined in claim 1, wherein said container end is formed integrally with the top of a container body.

6. A metal container end for attachment to a container, said end comprising:

a neck portion having a lower edge;

said neck portion having a generally cylindrical upper part of less diameter than said lower edge and including a dispensing opening with a surrounding curl;

a first set of neck lugs formed outward to a first diameter about said upper part for cooperation with a closure cap, said first set of neck lugs being of generally elongated shape spaced apart around said neck portion and including an upward extending ramp portion and cam surfaces facing downward of said upper neck portion at a common distance from the surrounding curl;

a removable closure cap adapted to cover said dispensing opening and including a top panel and a rim shaped to extend downward from said top panel around said upper neck portion and said neck lugs, said rim terminating in a generally circular lower edge;

a seal member within said rim of said cap adjacent said top panel;

a set of cap lugs formed inward within said rim of said cap member to a second diameter less than said first diameter of said neck lugs to engage under said neck lugs sufficiently to retain said seal member in sealed relationship with said surrounding curl of said dispensing opening;

said cap lugs being spaced apart around said cap rim in correspondence with the spacing between said neck lugs, whereby said cap lugs can be moved thereunder and into contact with said cam surfaces; and a second set of neck lugs formed outward to the first diameter about the upper part for cooperation with the closure cap, the second set of neck lugs having a conformation different than the first set and including a cam surface at a common distance from the surrounding curl with a reduced circumferential arcuate length than the cam surfaces associated with the first set of neck lugs and a venting portion having a downturned end extending from a lower surface, the venting portion is located at a second distance closer to the surrounding curl than the cam surfaces allowing at least one of said cap lugs to release from an associated one of said cam surfaces and to free a segment of said seal member from the seal surface while at least one of said cap lugs associated with said first set of neck lugs remain in contact with the associated cam surface, thereby initiating a venting path through said cap rim through which path relative pressure between the interior and exterior of the container is equated before the cap is removed.

7. A container end as defined in claim 6, wherein at least one of said neck lugs includes a venting portion having a surface spaced above the cam surface of said one lug to urge an associated cap lug to move upward toward said seal surface during opening rotation of said cap and initiate opening of the contact between the seal surface and said seal member.

8. A container end as defined in claim 7, wherein at least one of said neck lugs includes a stop to prevent further rotation of the cap in an opening direction.

9. A container end as defined in claim 6, wherein one of said neck lugs includes a depending surface to engage one of the cap lugs traversing an opening between neck lugs, to raise said one cap lug during further opening rotation of the cap so as to overcome a force due to negative pressure within the container and initiate venting of the container interior.

10. A container end as defined in claim 6 wherein at least one of said neck lugs is shorter in length than the other neck lugs, forming an enlarged space between said one neck lug and an adjacent neck lug to permit one of the cap lugs to move upward toward said seal surface and cause an initial opening of the contact between the seal surface and said seal member, the other of said neck lugs preventing release of the other cap lugs during the initial opening action.

11. A container end as defined in claim 10, wherein the spaces between the neck lugs are successively decreased, while still wider than the width of said cap lugs, so as to release the cap lugs in sequence.

12. The method of manufacturing a container end including a neck member for incorporation with a can body and a cap member forming with the neck member, a resealable closure comprising the steps of:

forming on the neck member a generally cylindrical upper neck part;

forming a curl upon the upper neck part to define a dispensing opening;

forming a first set of neck lugs projecting outwardly of the upper neck part to a predetermined first diameter, and forming cam surfaces on the first set of neck lugs facing away from said dispensing opening;

providing an inverted generally cup-shaped cap member including a top panel and a rim depending from the top panel and a curl formed about the edge of the rim;

forming a set of cap lugs extending inwardly from the rim to a predetermined second diameter less than the diameter of the neck lugs for interaction with the cam surfaces on the neck lugs upon rotation of the cap to maintain the top panel and any seal therein against the outward curl surrounding the dispensing opening; and providing at least a second set of neck lugs having a conformation different than the first set of neck lugs having a cam surface with reduced length, located on a common plane with the cam surfaces of the first set of neck lugs and a venting portion having a downturned end extending from a lower surface, the venting portion is located at a second distance closer to the curl than the cam surface, allowing at least one of the cap lugs to release from an associated one of the cam surfaces and to free a segment of said seal member from the seal surface while the cap lugs associated with the first set of neck lugs temporarily remain in contact with the associated cam surface so as to initiate a venting path through the cap rim to equate pressure between the interior and exterior of the container prior to completely opening the cap.

* * * * *